US006392525B1

(12) United States Patent
Kato et al.

(10) Patent No.: US 6,392,525 B1
(45) **Date of Patent: *May 21, 2002**

(54) MAGNETIC ELEMENT AND METHOD OF MANUFACTURING THE SAME

(75) Inventors: Junichi Kato; Osamu Inoue; Seiichi Nakatani; Koichi Hirano; Toshiyuki Asahi, all of Osaka (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/472,252

(22) Filed: Dec. 27, 1999

(30) Foreign Application Priority Data

Dec. 28, 1998 (JP) ..... 10-372539
Oct. 14, 1999 (JP) ..... 11-292954

(51) Int. Cl.[7] ..... H01F 27/24

(52) U.S. Cl. ..... 336/233; 336/83; 336/96; 336/200

(58) Field of Search ..... 335/301–302; 336/200, 65, 83, 96, 233; 257/531

(56) References Cited

U.S. PATENT DOCUMENTS 5,801,521 A * 9/1998 Mizoguchi et al. ..... 336/200
6,181,232 B1 * 1/2001 Kitamura ..... 336/200

FOREIGN PATENT DOCUMENTS

| | | | |
|---|---|---|---|
| EP | 0 869 518 A1 | | 10/1998 |
| JP | 54-57625 | * | 5/1979 |
| JP | 61-136213 A | | 6/1986 |
| JP | 5-243050 | * | 9/1993 |
| JP | 06-342725 A | | 12/1994 |
| JP | 09-092540 A | | 4/1997 |
| JP | 09-270334 A | | 10/1997 |

* cited by examiner

*Primary Examiner*—Lincoln Donovan
*Assistant Examiner*—Tuyen T. Nguyen
(74) *Attorney, Agent, or Firm*—Merchant & Gould PC

(57) ABSTRACT

A magnetic element including: a composite magnetic member A containing a metallic magnetic powder in an amount of 50–70 vol. % and a thermosetting resin in an amount of 50–30 vol. %; a magnetic member B that is at least one selected from a ferrite sintered body and a pressed-powder magnetic body of a metallic magnetic powder; and a coil. The magnetic element is characterized in that a magnetic path determined by an arrangement of the coil passes the magnetic member A and the magnetic member B in series and the coil is embedded in the magnetic member A. The present invention also provides a method for manufacturing the magnetic element.

7 Claims, 12 Drawing Sheets

MAGNETIC ELEMENT AND METHOD OF MANUFACTURING THE SAME

FIELD OF THE INVENTION

The present invention relates to a magnetic element such as an conductor, a choke coil, a transformer, or the like in electronic equipment, particularly a miniature magnetic element used under a large current and to a method of manufacturing the same.

BACKGROUND OF THE INVENTION

With the reduction in size and thickness of electronic equipment, the reduction in size and thickness of components and devices used therein also has been demanded strongly. On the other hand, LSIs such as a CPU and the like have come to be made up of an increasing number of circuit components and a current of several amperes to several tens of amperes may be supplied to a power circuit provided in the LSIs. Therefore, similarly an inductor such as a choke coil used therein has been required to reduce its size, to lower the resistance, although being contrary to the size reduction, by enlarging the cross-sectional area of a coil conductor, and not to lower the inductance greatly with DC bias. The operation frequency has come to be higher and therefore it has been required that the loss in a high frequency area is low. Furthermore, in order to reduce the cost, it has been necessary that component elements with simple shapes can be assembled in easy processes. In other words, it has been demanded that a miniaturized thin inductor that can be used under a large current and at a high frequency is provided at a low cost.

In the case where an inductor is formed by providing a winding around a toroidal core, the inductance of the inductor is expressed by the following formula:

$$L \sim \mu \times S = N^2/r$$

wherein L indicates inductance, $\mu$ magnetic permeability, S the cross-sectional area of a magnetic path, N the number of turns, and r the length of the magnetic path. From this formula, it is understood that a large value of L is obtained when the magnetic permeability $\mu$, the cross-sectional area S of a magnetic path, and the number of turns N are increased and the length r of the magnetic path is reduced. However, when the magnetic permeability is increased, the magnetic flux density is saturated even at a small current value. The magnetic permeability is decreased at higher current values, thus deteriorating the DC bias characteristics (the inductance value (L) characteristics dependent on a direct current). The enlargement of the cross-sectional area of the magnetic path is contrary to the size reduction and results in a long lead wire in the case of the same number of turns, thus causing a high resistance. The use of a lead wire with a large cross-sectional area to prevent this further goes against the size reduction. The increase in number of turns is contrary to the size reduction and also causes a high resistance. To shorten the magnetic path leads to the size reduction but the number of turns cannot be increased in that case. Therefore, generally it has been difficult to obtain a miniature inductor that has a high inductance, excellent DC bias characteristics, and a low resistance in a winding and that can be used not only at low frequencies but also at high frequencies.

An inductor that has been used practically will be described as follows.

In an EE-type or EI-type ferrite core and a coil that have been used most commonly, because a ferrite material has a relatively high magnetic permeability and a lower saturation magnetic flux density compared to that of a metallic magnetic material, the inductance is decreased greatly due to the magnetic saturation when the ferrite material is used without being modified, resulting in poor DC bias characteristics. Therefore, in order to improve the DC bias characteristics, usually such a ferrite core and a coil have been used by providing a gap in any position in a magnetic path of the core to decrease the apparent magnetic permeability.

In an inductor in which a Fe—Si—Al based alloy, a Fe—Ni based alloy, or the like that has a higher saturation magnetic flux density than that of ferrite is used as a core material, because such a metallic material has a low electrical resistance, the increase in high operation frequency to several hundreds of kHz to MHz as in the recent situation results in the increase in eddy current loss and thus the inductor cannot be used without being modified. Therefore, a so-called dust core has been used, which is obtained by superposing members, which have been formed to have thin bodies, via an insulating layer or which is formed using a pulverized material that is insulated.

It also has been proposed to combine and use a plurality of magnetic bodies. One obtained by winding a coil around a ferrite core with rib and then dipping them into a mixed solution of magnetic powder and a resin material (JP-A-61-136213) and one obtained by preparing two members formed through the superposition of a plurality of thin magnetic metal bodies, providing a planar coil between the two members, and fixing magnetic powder with a dispersed adhesive (JP-A-9-270334) have been described as being effective for reducing the size of an inductor. In addition, one obtained by providing a planar coil between two ferrite sheets and fixing ferrite powder with a dispersed adhesive in order to reduce the leakage flux has been proposed (JP-A-6-342725), although it is not described as achieving the size reduction.

With respect to the configurations of inductors, many conventional inductors have been formed of an EE or EI type core and a coil. However, in order to obtain a thin inductor, JP-A-9-92540 describes using one formed by winding the coil spirally in a plane. Further, JP-A-9-205023 describes that the terminal on the internal circumference side (hereinafter referred to as an "inner terminal") of a spirally wound coil is lead out by providing a cutout in a core, so that the thickness corresponding to that of the lead wire is reduced.

However, when a ferrite material is used and a gap is provided anywhere in a magnetic path to decrease the apparent magnetic permeability, there has been a problem that a core vibrates in this gap portion when being operated with an alternating current, thus generating noise.

When thin metallic magnetic bodies with a high saturation magnetic flux density are superposed via insulating layers, the thin bodies that can be used at high frequencies should be formed to be sufficiently thin. Therefore, the cost increases and no complicated shape can be formed, which have been problems. Further, in order to obtain a dust core with characteristics good enough, it is necessary to make the dust core dense by the application of a very high pressure of about 10t/cm$^2$ in a molding process. Therefore, there have been problems that a special high-strength mold is required and complicated shapes are formed with difficulty.

In the types disclosed in JP-A-61-136213 and JP-A-6-342725 that are included in the types in which a plurality of magnetic bodies are combined and used, a member obtained by dispersing ferrite in a resin is used. However, since there is a limitation in the filling rate of the ferrite, there has been a problem that the saturation magnetic flux density of this member is low and therefore the DC bias characteristics are poor. Furthermore, in the type disclosed in JP-A-9-270334, the kind of the magnetic body to be mixed with resin is not described, but it is necessary to prepare a member formed by superposing a plurality of thin magnetic metal bodies in all cases, resulting in a high cost. In addition, since the upper and lower surfaces of an element are formed of metallic magnetic bodies, the electrical resistance is low and therefore insulation is required, and complicated shapes cannot be formed, which also have been problems.

SUMMARY OF THE INVENTION

The present invention seeks to provide a magnetic element, such as an inductor, a choke coil, a transformer, or the like, that is suitable for the use under a large current in various types of electronic equipment.

A magnetic element of the present invention includes: a composite magnetic member A containing a metallic magnetic powder in an amount of 50–70 vol. % and a thermosetting resin in an amount of 50–30 vol. %; a magnetic member B that is a ferrite sintered body or a pressed-powder magnetic body of the metallic magnetic powder; and a coil. A magnetic path determined by the arrangement of the coil passes the magnetic member A and the magnetic member B in series. The coil is embedded in the magnetic member A.

In the magnetic element of the present invention, it is preferable that the gaps in the coil are filled with the magnetic member A. Further, it is preferable that the coil is wound around the magnetic member B.

It is preferable that the magnetic member B is positioned outside the magnetic member A in which the coil is embedded. In this case, it is further preferable that a plurality of plate-like magnetic members Bare included and are spaced from one another at 500-$\mu$m intervals or less, particularly at 300-$\mu$m intervals or less, the magnetic member A in which the coil is embedded is arranged in the intervals, and the coil is formed of a conductor wound in a planar shape.

Furthermore, it is preferable that an oxide insulating layer is formed on the surface of the metallic magnetic powder contained in the magnetic member A. In this case, it is further preferable that the metallic magnetic powder contained in the magnetic member A contains Fe as the main component and Al, and the oxide insulating layer on the surface of the metallic magnetic powder is an insulating layer containing aluminum oxide as the main component, which is formed by a heat treatment in the presence of oxygen.

In this specification, the main component denotes a constituent accounting for at least 50 wt. %.

The present invention also provides a method of manufacturing the above-mentioned magnetic element. A first method of manufacturing the magnetic element according to the present invention includes: preparing a paste containing magnetic powder and thermosetting resin; filling gaps around the coil with the paste; and forming the magnetic member A from the paste by curing the thermosetting resin through a treatment with heat.

A second method of manufacturing a magnetic element according to the present invention includes: preparing a slurry containing magnetic powder and thermosetting resin; forming an uncured composite sheet from the slurry; and forming the magnetic member A from the uncured composite sheet by curing the thermosetting resin through a treatment with heat and pressure.

DETAILED DESCRIPTION OF THE INVENTION

In one type of magnetic elements according to the present invention, a magnetic member A with a low magnetic permeability in which a coil has been embedded and a magnetic member B with a high magnetic permeability are arranged in series in at least one magnetic path determined depending on the coil. These members as a unit form one chip. By generating the magnetic path with the magnetic members A and B, even when no extra gap is provided, excellent DC bias characteristics and a higher inductance compared to that in a conventional magnetic element can be obtained. Further, by the selection of such various configurations as exemplified as follows, the cross-sectional area and length of the magnetic path, the number of turns in a winding, and the resistance in the winding can be varied over a wide range without changing the outer size. In addition, the magnetic member may be formed to be very thin, and therefore inductors with characteristics corresponding to various applications can be obtained. Moreover, since the magnetic element is integrally formed with the magnetic member A in which thermosetting resin is used, no noise is generated even when an alternating current is applied.

Preferable types of magnetic elements according to the present invention are described with reference to the drawings as follows. In the following, mainly examples of inductors and choke coils will be described. However, the present invention is not limited to them and exhibits its effect even when being applied to a transformer requiring a secondary winding or the like.

In FIGS. 1 to 4, each magnetic element is formed so that the magnetic path inside a conductor coil is generated in the direction perpendicular to a chip face (the direction of the shorter side in a chip). On the other hand, in FIGS. 5 to 8, each magnetic element is formed so that the magnetic path inside a conductor coil is generated in the direction parallel to a chip face (the longitudinal direction in the chip). In each configuration shown in FIGS. 1 to 4, a large cross-sectional area of the magnetic path can be obtained easily, but it is difficult to increase the number of turns. On the other hand, in each configuration shown in FIGS. 5 to 8, it is difficult to obtain a large cross-sectional area of the magnetic path, but the number of turns can be increased easily.

Figure 1:
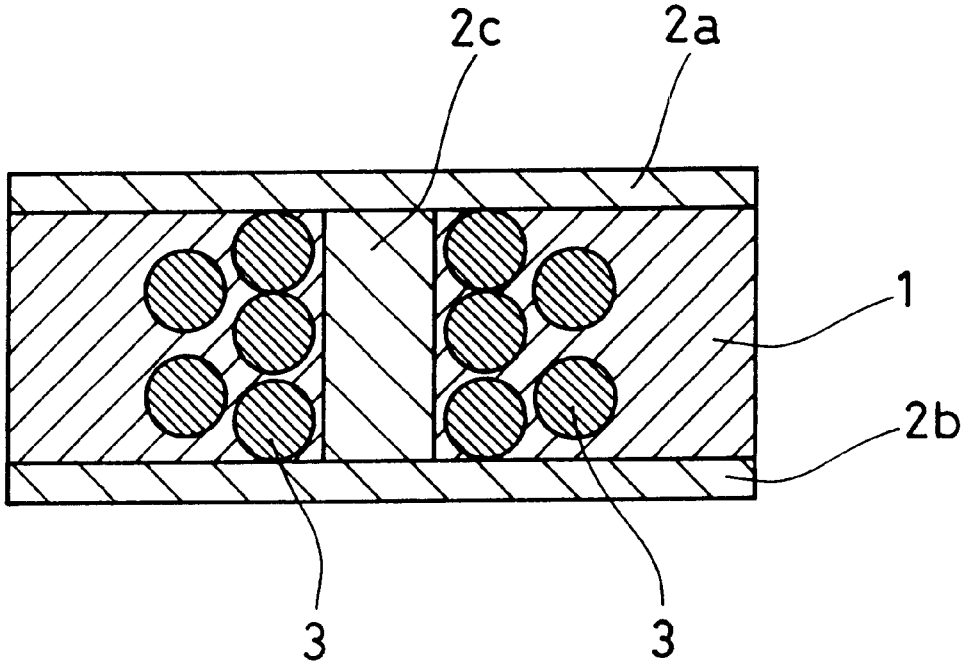
FIG. 1 is a cross sectional view of one type of magnetic elements according to the present invention.

In FIG. 1, two plate magnetic members B2*a* and 2*b* are arranged in parallel to each other on the upper and lower sides and are connected through a columnar magnetic member B2*c* at the vicinities of their centers. A coil 3 is wound around the columnar magnetic member B2*c* and is embedded in a magnetic member A1. In this case, the magnetic path generated inside the magnetic element is as follows: the columnar magnetic member B2*c* the plate magnetic member B2*a*→the magnetic member A 1→the plate magnetic member B2*b*→the columnar magnetic member B 2*c*.

Figure 2:
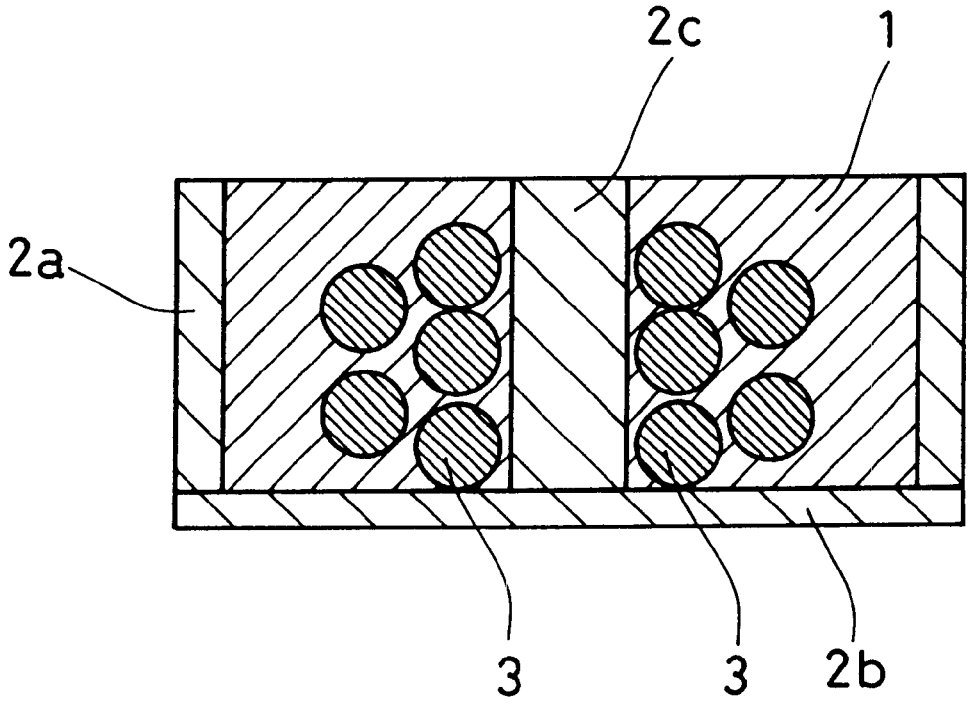
FIG. 2 is a cross sectional view of another type of magnetic elements according to the present invention.

In FIG. 2, in the vicinity of the center of one plate magnetic member B2*b*, a columnar magnetic member B2*c* is positioned perpendicularly to the magnetic member B2*b*. A coil 3 is wound around the columnar magnetic member B2*c* and is embedded in a magnetic member A1. In the vicinity of the periphery of the magnetic member B2*b*, a columnar or plate magnetic member B2*a* is arranged perpendicularly to the magnetic member B2*b*. In this case, the magnetic path generated is as follows: the columnar magnetic member B2*c*→the magnetic member A1→the columnar or plate magnetic member B2*a*→the plate magnetic member B2*b* at the bottom→the columnar magnetic member B2*c*.

Figure 3:
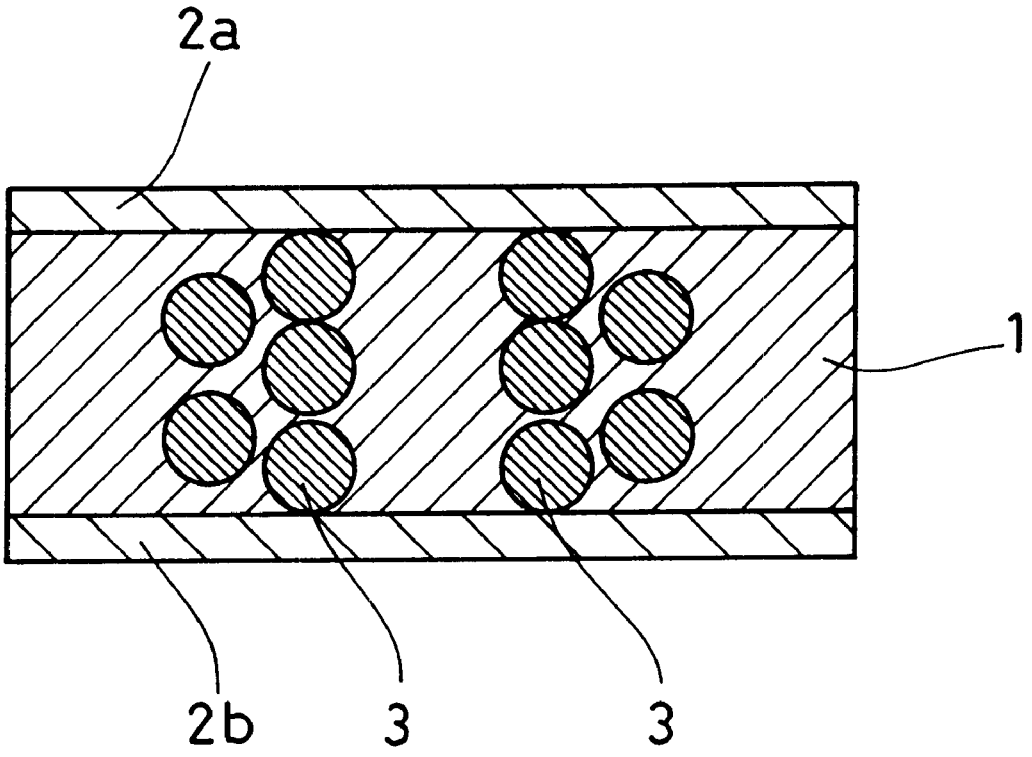
FIG. 3 is a cross sectional view of still another type of magnetic elements according to the present invention.

In FIG. 3, two plate magnetic members B2*a* and 2*b* are arranged in parallel to each other on upper and lower sides and the space between the magnetic members B2*a* and 2*b* is filled with a magnetic member A1. A coil 3 is embedded in the magnetic member A1. In this case, the magnetic path generated is as follows: the magnetic member A1 inside the coil 3→the plate magnetic member B2*a*→the magnetic member A1 outside the coil 3 the plate magnetic member B2*b*→the magnetic member A1 inside the coil 3.

Figure 4:
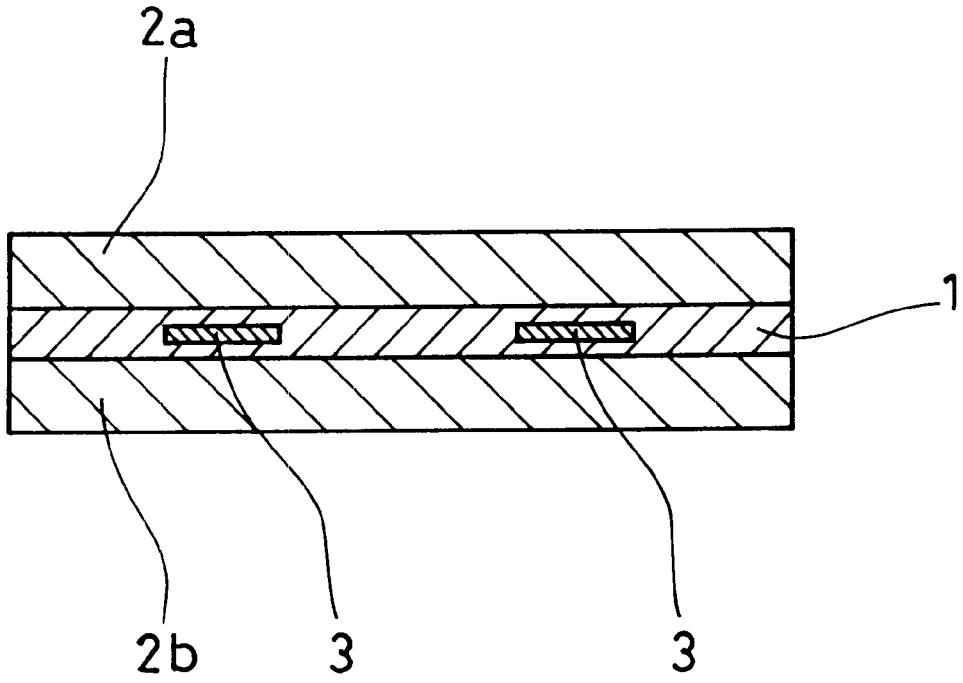
FIG. 4 is a cross sectional view of yet another type of magnetic elements according to the present invention.

The configuration shown in FIG. 4 is basically the same as that shown in FIG. 3, but is different in that two plate magnetic members B2*a* and 2*b* are arranged in close proximity to each other and a coil 3 is formed in a planar shape. A conductor is formed in a one-turn coil shape or a meander shape, or is wound in a planar shape and then its ends are lead to the outside through a cutout provided in the magnetic members B. FIG. 4 shows the case where a foil-like coil 3 is wound one turn specially to reduce the thickness. In this case, the magnetic path generated is the same as that in the case shown in FIG. 3.

Figure 5:
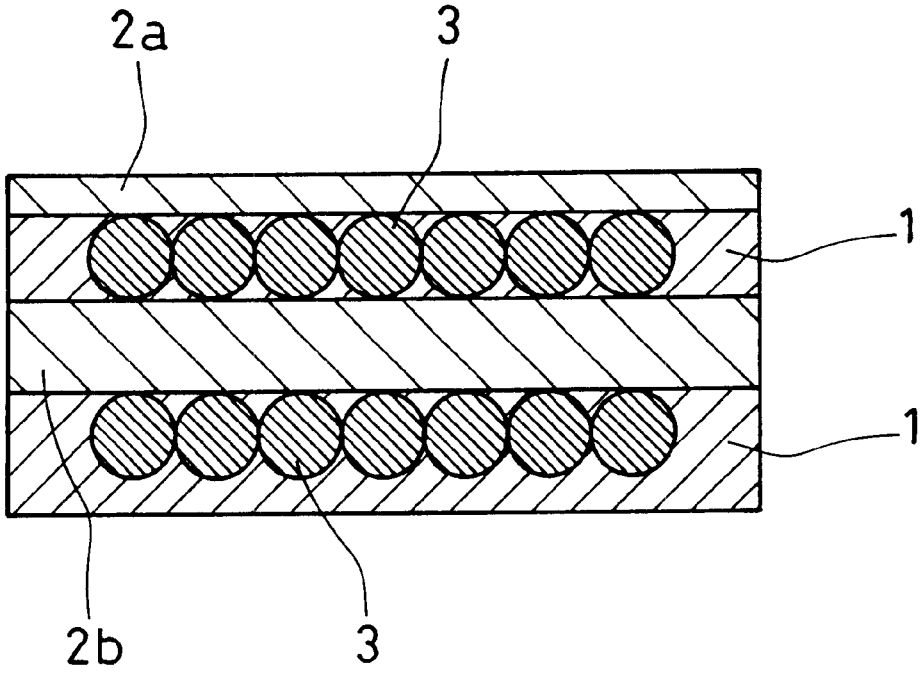
FIG. 5 is a cross sectional view of yet another type of magnetic elements according to the present invention.

In FIG. 5, a coil 3 is wound around a columnar magnetic member B 2*b* in a solenoidal form and is embedded in a magnetic member A1. Another plate magnetic member B2*a* is arranged in parallel to the magnetic member B2*b*. In this case, most of the magnetic fluxes generated in the upper half portion of the element shown in the figure are as follows: the columnar magnetic member B2*b*→the magnetic member A1→the plate magnetic member B2*a*→the magnetic member A1→the columnar magnetic member B2*b*. In addition, a part of magnetic fluxes generated in the lower half portion is as follows: the columnar magnetic member B2*b*→the magnetic member A1→the columnar magnetic member B2*b*.

Figure 6:
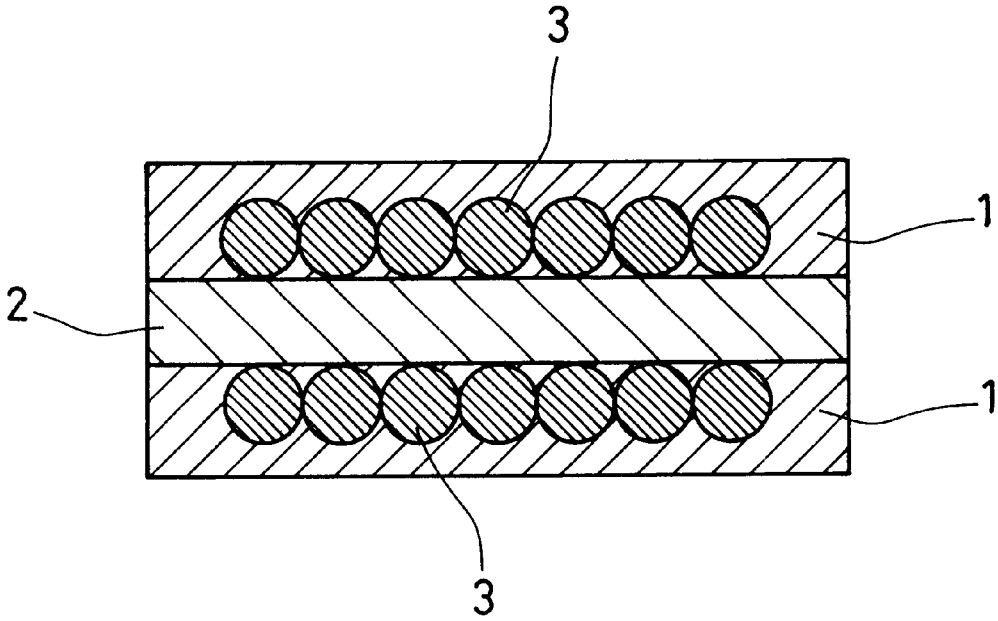
FIG. 6 is a cross sectional view of still another type of magnetic elements according to the present invention.

In FIG. 6, a coil 3 is wound around a columnar magnetic member B2 in a solenoidal form and is embedded in a magnetic member A1. In this case, the magnetic path generated is as follows: the columnar magnetic member B2→the magnetic member A1→the columnar magnetic member B2.

Figure 7:
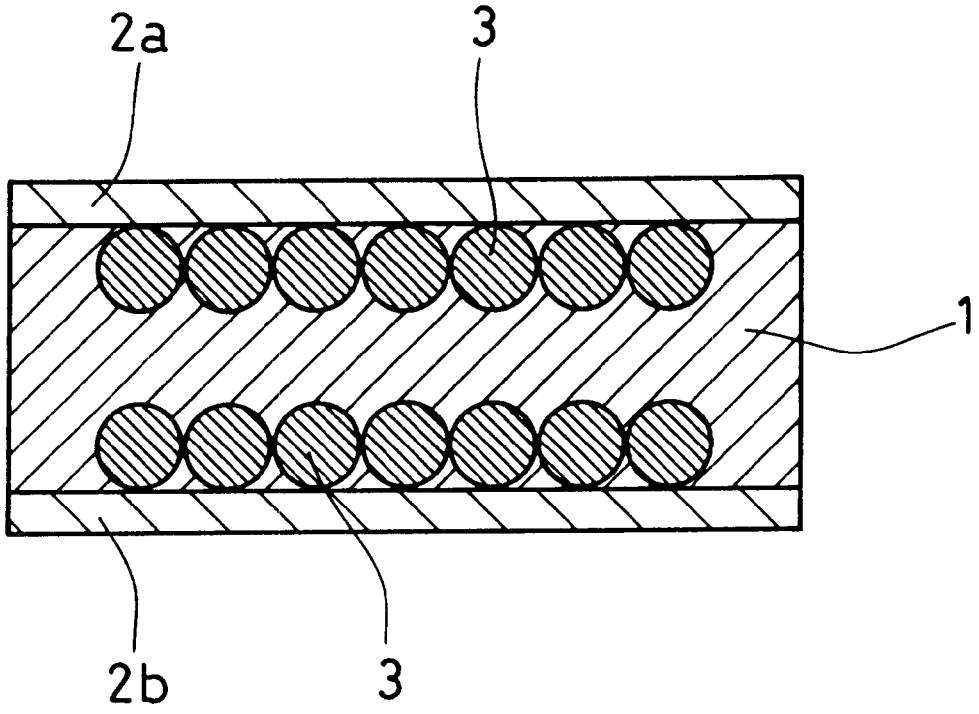
FIG. 7 is a cross sectional view of yet another type of magnetic elements according to the present invention.

In FIG. 7, a solenoidal coil 3 is embedded in a magnetic member A1, and two plate magnetic members B2*a* and 2*b* are arranged so as to sandwich the magnetic member A1 in which the solenoidal coil 3 has been embedded. In this case, the magnetic path generated is as follows: the magnetic member A1 inside the coil→the magnetic member A1 around the ends of the coil→the plate magnetic member B2*a* (2*b*)→the magnetic member A1 around the ends of the coil→the magnetic member A1 inside the coil.

Figure 8:
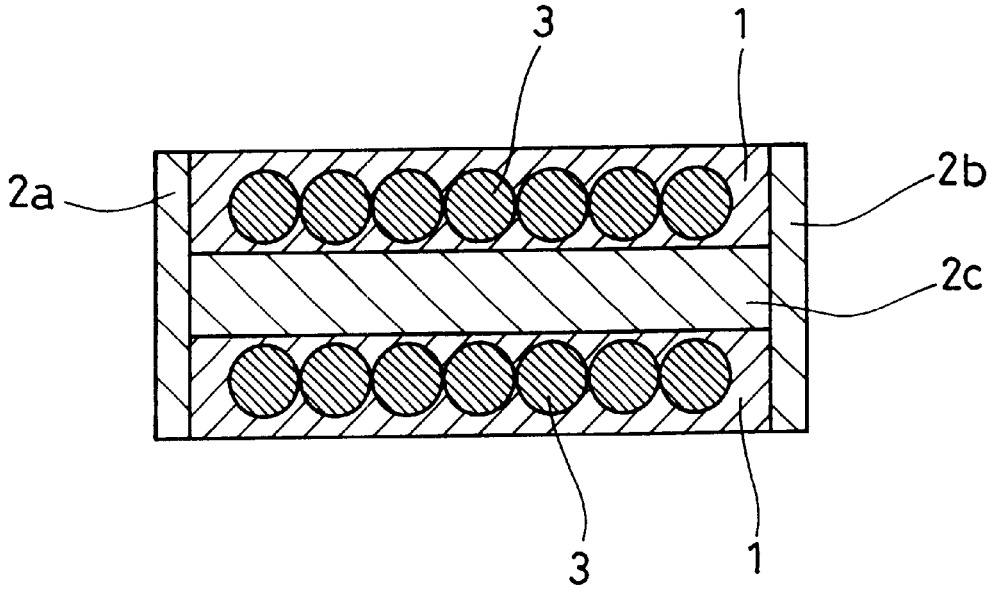
FIG. 8 is a cross sectional view of another type of magnetic elements according to the present invention.

In FIG. 8, a coil 3 is wound around a columnar magnetic member B 2*c* in a solenoidal form and is embedded in a magnetic member A1. Two other plate magnetic members B2*a* and 2*b* are arranged perpendicularly to the columnar magnetic member B2*c*. In this case, the magnetic path generated is as follows: the columnar magnetic member B2*c*→the plate magnetic member B2*a*→the magnetic member A1→the plate magnetic member B2*b*→the columnar magnetic member B2*c*.

In the above-mentioned configurations, when their sizes are equal and the same types of magnetic members A and Bare used, relatively high inductance values are obtained in the elements shown in FIGS. 1, 2, and 5, and inductance values obtained in the elements shown in FIGS. 4, 6, and 7 are relatively low. In the element shown in FIG. 6, the magnetic member A with a high resistance value is exposed on the surface. Thus, this element has a high-resistance surface and therefore is advantageous for being mounted. In the element shown in FIG. 4, the inductance value L is small, but the value L does not decrease greatly even when the height is reduced. Therefore, the configuration shown in FIG. 4 enables the reduction in thickness of the element. Generally, more excellent DC bias characteristics are obtained as the value L decreases.

In the above-mentioned figures, it is supposed that a rectangular-plate inductor chip is used, which has a rectangular shape with sides of around 3 to 20 mm, a thickness of about 1 to 5 mm, and a ratio of the length of one side/the thickness of about 2/1 to 8/1. However, the dimension is not limited to this and the inductor chip may have a disc-like shape or the like. Furthermore, the figures mentioned above show examples of the configurations according to the present invention. The present invention is not limited to those configurations and configurations other than those or configurations obtained by partially modifying or combining those configurations also may be employed. Since it is possible to allow the shape of the ferrite or composite to be used to have a considerable degree of freedom, further complicated shapes can be formed easily. The configurations of the present invention are not particularly limited as long as the magnetic members A and B are arranged in series in a magnetic path and a conductor coil is embedded in the magnetic member A.

Next, an embodiment will be described further in detail using an example with the same configuration as in FIGS. 3 and 4.

Figure 9:
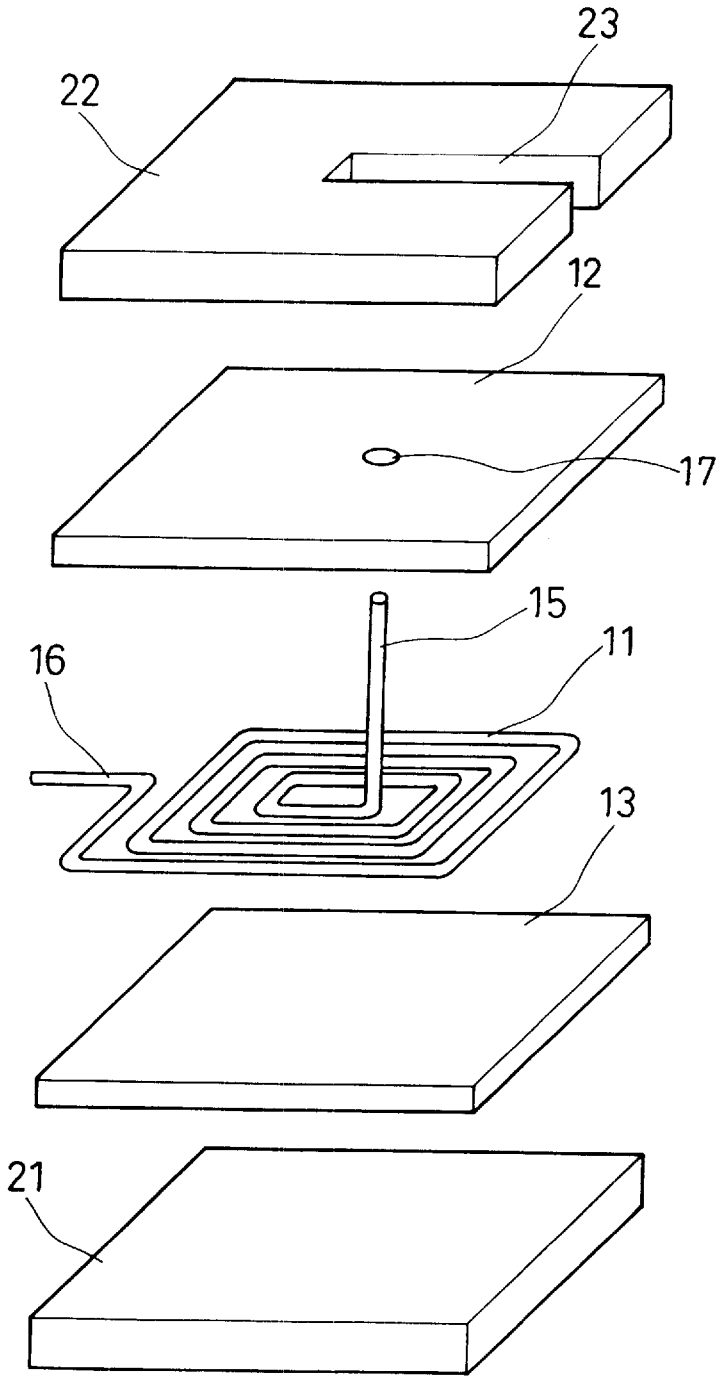
FIG. 9 is an exploded perspective view of one type of magnetic elements according to the present invention.
Figure 10:
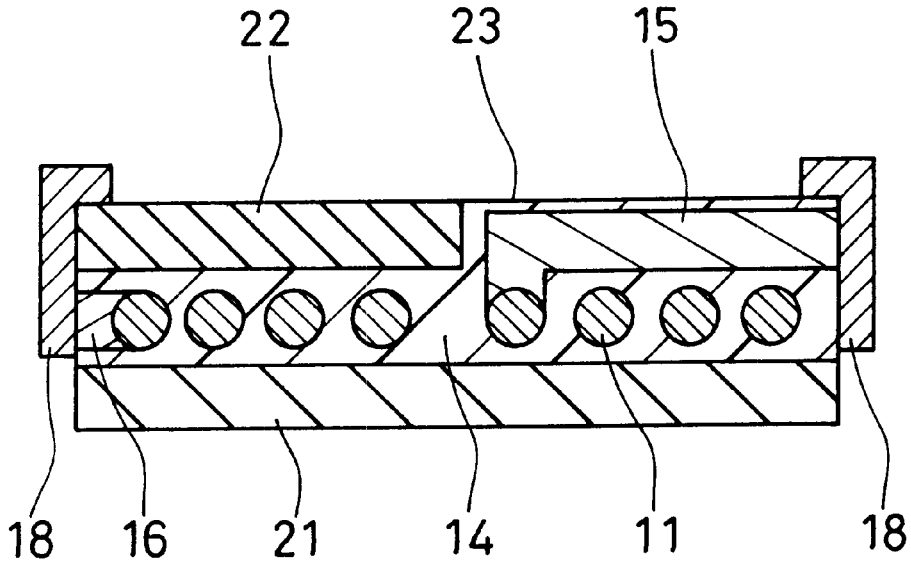
FIG. 10 is a cross sectional view of the magnetic element shown in FIG. 9.

FIG. 9 is a perspective view showing the assembly of a magnetic element as an example and FIG. 10 is a cross sectional view of the magnetic element that has been assembled. An air-core coil 11 is a round copper wire or a rectangular copper wire that is wound spirally. The surface of the air-core coil 11 is covered with insulating resin. Uncured composite sheets 12 and 13 to be a magnetic member A are obtained by: mixing an organic solvent with the mixture of a magnetic material powder in an amount of 50–70 vol. % and a thermosetting resin in an amount of 30–50 vol. % to obtain a slurry; forming sheets from the slurry by doctor blade formation or extrusion molding; and evaporating most of the organic solvent to dry the sheets.

A first magnetic member B21 and at least one uncured composite sheet 13 are placed in a mold (not shown in the figure) and the air-core coil 11 whose terminal 15 on its inner side (hereinafter referred to as a "inner terminal") is inserted into a hole 17 in at least one other uncured composite sheet 12 that is placed thereon. Further, the inner terminal 15 is bent and is received in a slit 23 of a second magnetic member B22.

While being compressed, these members are maintained for a time required for curing the thermosetting resin. In a step of heating and pressurization, the uncured composite sheets 12 and 13 come to have a low viscosity temporarily. Therefore, the gaps in the air-core coil 11 and in the slit 23 are filled up and thus an integrated composite magnetic body A14 is formed. The inner terminal 15 and an outer terminal 16 (a terminal on the outer side of the coil 11) are connected to lead terminals 18 respectively, thus completing the magnetic element.

The coil may be formed of a round wire, a rectangular wire, a foil-like wire, or the like and may be selected according to the configuration to be employed, the intended use, or the required inductance or resistance. It is desirable that the material of the conductor have a low resistance. Therefore, copper or silver is preferable as the material of the conductor, and particularly copper is preferable in general. In addition, it is desirable that the surface of the conductor be covered with insulating resin.

The magnetic member A is a mixture of metallic magnetic powder and thermosetting resin. It is desirable that the magnetic powder have a high magnetic permeability and a high saturation magnetic flux density. Particularly, a metal powder of a Fe—Si—Al based alloy, a Fe—Ni based alloy, or the like can be used. It is desirable that the powder have a particle diameter of 5 to 100 $\mu$m, since it is difficult to increase the ratio of the powder mixed with resin when the particle size is too small and the strength is decreased easily when the magnetic member A is thin and the particle size is too big. Since the metal powder is used, sufficient insulation cannot be obtained merely by mixing the metal powder with the resin in some cases. In such cases, it is desirable that an insulating coating film be preformed on the surface of each powder. In this case, when using a metal powder containing Al in Fe—Al—Si or the like, an insulating coating film containing aluminum oxide as the main component can be formed easily on the surface by a heat treatment in the air. Preferably, the oxide coating film in this case has a thickness in the range of 5 nm–100 nm. An excessively thin oxide coating film causes a low insulation resistance, and an excessively thick oxide coating film causes a low magnetic permeability.

As the thermosetting resin, epoxy resin, phenol resin, or the like can be used. In order to improve the dispersibility of the metallic magnetic powder in the thermosetting resin, a small amount of dispersant may be added, and a plasticizer or a solvent may be added suitably.

With respect to the mixture ratio of the magnetic powder and the resin, the magnetic permeability of the magnetic member A increases as the amount of the magnetic powder increases. The saturation magnetic flux density is obtained by multiplying the saturation magnetic flux density of the metallic magnetic powder itself by its volume fraction. For instance, when using a sendust (Fe—Al—Si) powder whose saturation magnetic flux density is 1 tesla and whose volume fraction is 50%, a magnetic member to be obtained has a saturation magnetic flux density of 0.5 tesla. However, when the effect of increasing the magnetic permeability of the magnetic member A is exhibited to its maximum and conversely an amount of the resin comes to be too small, disadvantages occur, which include the deterioration in formability in an uncured state to cause the difficulty in embedding the conductor coil, the decrease in strength after curing, or the like. Therefore, it is preferable that the mixture contains a magnetic powder in an amount of 50–70 vol. % and a thermosetting resin in an amount of 50–30 vol. %.

When employing a manufacturing method using a paste, it is preferred to use no solvent, since pores tend to remain in a curing step in the case where a solvent is contained. When employing a manufacturing method using a slurry, it is desirable for the sheet formation that a small amount of solvent be contained, Most of this solvent is evaporated when the sheet is dried and even if some remains, the occurrence of the pores can be suppressed by the application of pressure in a molding step.

As the material of the magnetic member B, one with a high magnetic permeability, a high saturation magnetic flux density, and an excellent high frequency property is preferable. Materials that can be used practically include a ferrite sintered body such as MnZn ferrite, NiZn ferrite, or the like, or a dust core (a pressed-powder magnetic body) that is obtained by solidifying and condensing metallic magnetic powder such as a Fe—Si—Al based alloy, a Fe—Ni based alloy, or the like using a binder such as silicone resin, glass, or the like. The ferrite sintered body has a high magnetic permeability, is excellent in high frequency property, and can be manufactured at a low cost, but has a low saturation magnetic flux density. The dust core has a high saturation magnetic flux density and secures a certain degree of high frequency property, but has a low magnetic permeability. These materials may be selected depending on the intended use. However, since the magnetic member B may form an outer surface of an inductor, it is desirable that the electrical resistance be high. In this point of view, the ferrite is preferred to the dust core. In one inductor, two or more kinds of magnetic members B, for example, a NiZn ferrite sintered body and a dust core, may be combined and used.

In the combination of the magnetic members A and B, it is desirable that the saturation magnetic flux densities of both the members be high and approximately the same, because in the case where one of them has a low saturation magnetic flux density, only the one is magnetically saturated first, thus causing the deterioration in DC bias characteristics.

In the configuration shown in FIG. 4, it is difficult to increase the number of turns, since a planar coil is used for the purpose of the reduction in thickness. In such a case, in order to obtain a high inductance with a small number of turns, a higher effective permeability is required and it is necessary to increase the magnetic path length Lb in the magnetic member B with a higher magnetic permeability compared to the magnetic path length La in the magnetic member A with a lower magnetic permeability. In this configuration, since the length La is determined by the interval between the two magnetic members B, the interval is preferably 500 $\mu$m or less, more preferably 300 $\mu$m or less. It is preferred to use a foil-like body as the coil conductor to be sandwiched in such a narrow space.

As described above, the characteristics of the inductance elements can be improved compared to those of a conventional one without using a new material with a higher magnetic permeability and a higher saturation magnetic flux density than those of conventional materials. The reasons for this include the following points: by combining two kinds of magnetic members A and B with different characteristics and limiting the type of magnetic body to be used, (1) the effective permeability can be optimized;

(2) the magnetic members A and B are formed to have approximately the same saturation magnetic flux densities, thus preventing the deterioration in characteristics that is caused when either one of magnetic bodies is saturated first; and (3) the conductor coil is embedded in the magnetic member A. It is conceivable that by the points (1) and (2), the optimization depending on the operating condition is achieved and by the point (3), the space between the coil and the magnetic members, which has been a useless space in a conventional element, is used as a magnetic body, thus substantially increasing a cross-sectional area of the magnetic path.

EXAMPLES

Examples of the present invention will be described as follows.

First Example

Initially, a method of manufacturing an uncured composite sheet to be a magnetic member A will be described. An atomized powder (with a mean particle diameter of 25 $\mu$m) containing 85 wt. % of Fe, 9 wt. % of Si, and 6 wt. % of Al, which is a sendust alloy composition, and epoxy resin were weighed according to Table 1.

TABLE 1

| Sheet Mark | Magnetic Powder wt. % | Epoxy Resin Solid Content wt. % | Magnetic Powder vol. % |
|---|---|---|---|
| a | 82.0 | 18.0 | 44 |
| b | 85.0 | 15.0 | 50 |
| c | 90.0 | 10.0 | 61 |
| d | 91.5 | 8.5 | 65 |
| e | 93.0 | 7.0 | 70 |

As the epoxy resin, a solution containing 70 wt. % of bisphenol A type resin as a solid content and methyl ethyl ketone as a solvent was used and methyl ethyl ketone was added for the adjustment of the viscosity. Table 1 also shows the volume percentage of the magnetic powder in the case where the specific gravity of the sendust alloy is 6.9 and the specific gravity of epoxy is 1.2. The weighed magnetic powder and epoxy resin solution were placed in a polyethylene container and mixed for five minutes in a mixing machine in which the container is rotated on its own axis and on the axis of the mixing machine at the same time, thus preparing a slurry. Using a doctor blade, the slurry thus obtained was formed into a sheet on a polyethylene telephtalate film whose surface had been treated with silicone so that the sheet was released from the film easily. The sheet was dried at 50–100° C., thus obtaining an uncured composite sheet. When the magnetic powder contained therein exceeded 70% by volume, the viscosity was high and therefore the sheet formation was not possible.

This sheet was cut to obtain two square sheets whose one side was 12 mm. In one of the two sheets, a hole with a diameter of 1.5 mm was formed by punching.

A composite sheet of the composition d shown in Table 1 was cut into a ring shape, which was compressed at room temperature to be molded. A sample was prepared by curing the molded sheet at 150° C. for one hour and another sample was prepared by heating and compressing the molded sheet at 150° C. for 15 minutes, taking it out from a press, and then treating it with heat at 150° C. for one hour. The respective samples were formed into toroidal coils and their relative permeabilities were measured. The relative permeabilities of the sample pressurized at room temperature and the sample heated and pressurized were 15 and 22, respectively.

A coil was prepared by winding a copper wire with a diameter of 0.85 mm in a square spiral shape for 4.5 turns. The coil was formed so that one side of its outer form has about 10 mm and adjacent copper wires did not adhere to each other. The DC resistance of this coil was about 3 mΩ.

As a next step, a first magnetic member and a second magnetic member were prepared. The first magnetic member had a square plate shape whose one side was 12 mm. The second magnetic member had the same shape as that of the first magnetic member and was provided with an opening. These respective magnetic members were a dust core obtained by adding 3 wt. % of silicone resin to a sendust alloy and heating and compressing the mixture or a ferrite sintered body having a composition expressed by 49 $Fe_2O_3$—30ZnO—10NiO—11CuO.

Figure 11:
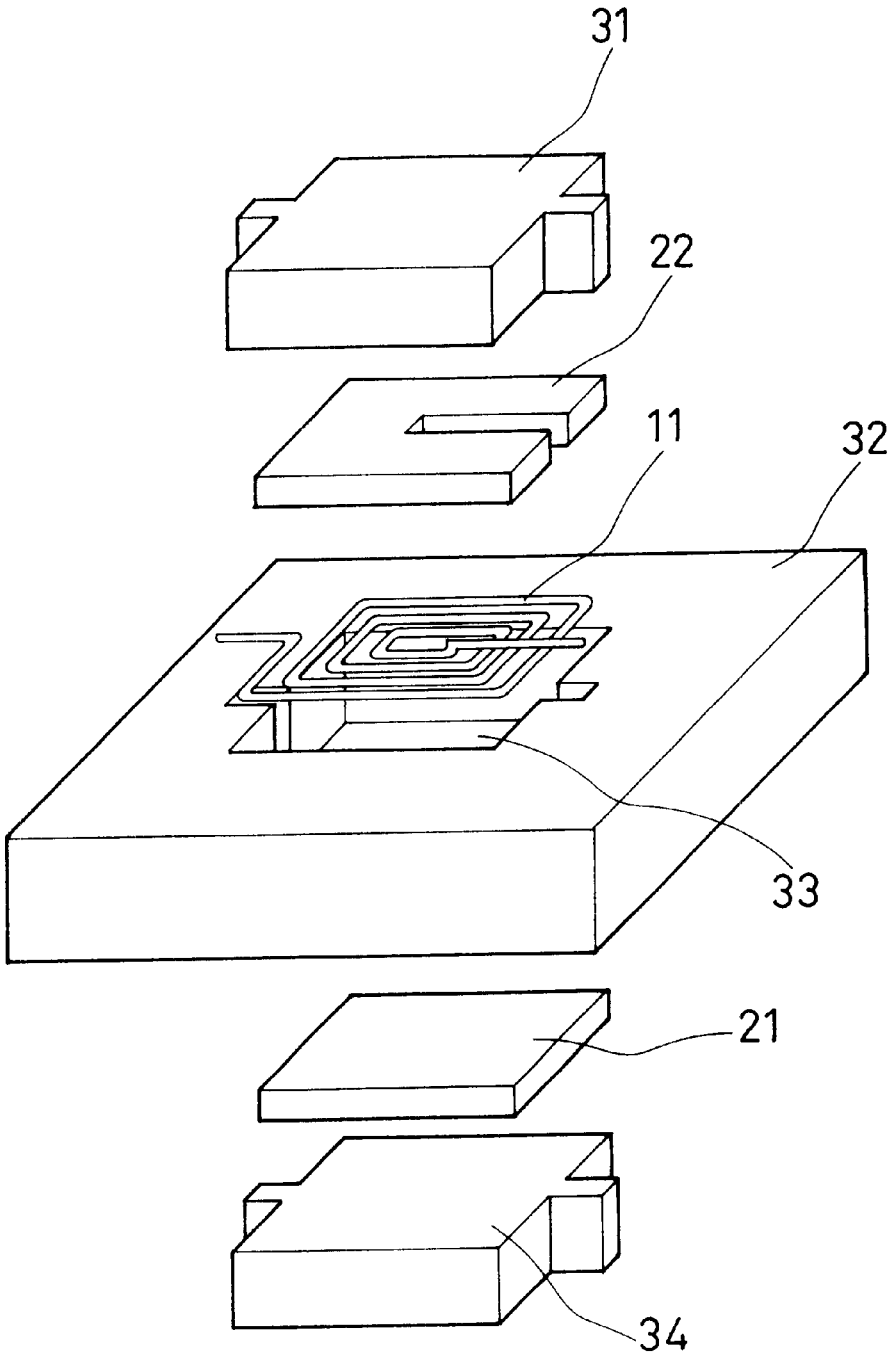
FIG. 11 is a perspective view for explaining a step in an example of methods for manufacturing a magnetic element of the present invention.

As shown in FIG. 11, the first magnetic member 21 was placed on the bottom of a lower mold 34, and an uncured composite sheet, an air-core coil 11, and another uncured composite sheet were superposed sequentially thereon. In FIG. 11, the uncured composite sheets are omitted. The inner terminal of the air-core coil was passed through the punched hole in the upper uncured composite sheet and then was bent in the direction opposite to the outer terminal.

Further, the second magnetic member 22 was superposed thereon. In this case, the inner terminal processed to be bent was received in a slit formed in the second magnetic member. After that, the above-mentioned respective members positioned between an upper mold 31 and a middle mold 32 and between the middle mold 32 and the lower mold 34 were heated and compressed for 15 minutes under the conditions of 150° C. and 500 kg/cm$^2$. Thus, the uncured composite sheets were fluidized to flow into the gaps in the air-core coil, the gaps between the coil and the first and second magnetic members, and the gap between the slit and the inner terminal, and both the magnetic members were bonded, thus forming one component as a whole. The component was taken out from the mold and then was treated with heat at 150° C. for one hour, thus sufficiently developing the hardness of the epoxy resin by the heat. Furthermore, the outer terminal and the inner terminal were connected to lead terminals respectively, thus forming a choke coil.

The material and thickness of a plate magnetic body of each choke coil thus formed were checked and the inductance (L) of each choke coil was measured at 100 kHz. In addition, the rate of change in superimposed DC was measured under superimposed DCs of 0A and 16A. The results are shown in Table 2.

TABLE 2

| | Sheet | Magnetic Member B | | Thickness | L | Change in superimposed |
|---|---|---|---|---|---|---|
| No. | Mark | Material | Thickness(mm) | (mm) | ($\mu$H) | DC (%) |
| 1 | a | Dust Core | 0.9 | 3.1 | 0.65 | −28 |
| 2 | b | Dust Core | 0.9 | 3.1 | 1.3 | −34 |
| 3 | c | Dust Core | 0.9 | 3.1 | 1.5 | −33 |

TABLE 2-continued

| | Sheet | Magnetic Member B | | Thickness | L | Change in super-imposed |
|---|---|---|---|---|---|---|
| No. | Mark | Material | Thickness(mm) | (mm) | (μH) | DC (%) |
| 4 | d | Dust Core | 0.9 | 3.1 | 1.6 | −36 |
| 5 | d | Dust Core | 0.65 | 2.5 | 1.2 | −36 |
| 6 | d | Dust Core | 0.5 | 2.3 | 0.92 | −34 |
| 7 | d | Dust Core | 0.3 | 2.0 | 0.84 | −34 |
| 8 | e | Dust Core | 0.9 | 3.1 | 1.4 | −33 |
| 9 | d | Ferrite | 0.5 | 2.5 | 1.8 | −49 |

As is apparent from Table 2, it was shown that only when a sheet a containing a small amount of magnetic powder was used, the value L was small, and thin choke coils were obtained in the case of using the sheets other than the sheet a.

Second Example

A powder of a sendust alloy and epoxy resin were weighed to have the composition c in Table 1 and were kneaded, thus preparing a composite paste. Then, by the same method as in the first example, using the paste instead of the composite sheets, a first magnetic member, a suitable amount of composite paste, a coil, a suitable amount of composite paste, and a second magnetic member were placed sequentially in a mold and were heated at 125° C. for 30 minutes without being compressed so that an element with a total thickness of 3.0 mm was obtained. The heated members were taken out from the mold and lead terminals were connected, thus obtaining a choke coil. The completed choke coil had a value L of 1.2 μH and a lowering rate in superimposed DC of −31%. Therefore, the value L was slightly lower than those shown in Table 2, but an approximately equivalent element was obtained.

Third Example

As in the first example, an atomized powder (with the mean particle diameter of 30 μm) of a sendust composition was prepared and was treated by heating in the air at 750° C. for one hour, thus forming an oxide insulating film on the surface of each powder. To this powder, bisphenol A type epoxy resin and a small amount of setting agent were added at the same ratio as in the first example, which was then mixed in a mixing machine for five minutes, thus preparing a paste containing magnetic powder.

A spool-shaped NiZn ferrite core was prepared as a magnetic member. This core had a configuration in which upper and lower circular plates were joined with a column. Each circular plate had a diameter of 8 mm and a thickness of 0.8 mm, and the column had a diameter of 2.5 mm. The total thickness of the core was 3 mm. A covered copper wire with a diameter of 0.5 mm was wound around this core to form a five-turn winding.

As a next step, this drum core was placed in a cylindrical container that has approximately the same diameter as that of the core and has a small hole for paste injection on its side face. From the hole for paste injection, the paste containing magnetic powder was injected and it was heated at 150° C. for 15 minutes to cure the paste, thus obtaining a composite magnetic body.

In order to make a comparison, an element formed by providing merely a winding around a drum core without using the composite magnetic body also was prepared. The values L of the inductors thus obtained were measured at 100 kHz and under superimposed DCs of 0A and 4A. In the inductor of the present invention, the values L at 0A and 4A were 2.2 μH and 1.7 μH, respectively. On the other hand, in the inductor of the comparative example, the values L at 0A and 4A were 1.3 μH and 1.2 μH, which were small.

The volume fraction of the magnetic powder in the above-mentioned composite magnetic body was about 57%. The same is true in the following examples.

Fourth Example

Figure 12:
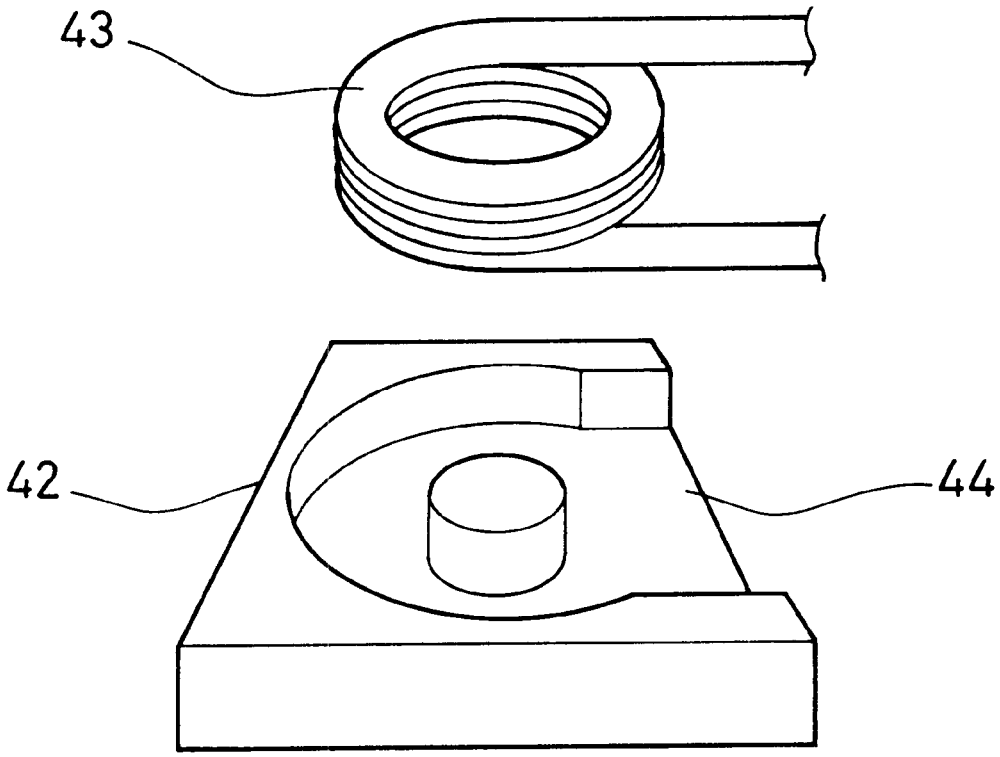
FIG. 12 is a perspective view for explaining a step in another example of methods for manufacturing a magnetic element of the present invention.

As shown in FIG. 12, a flat type conductor was wound in a solenoidal form and then was treated to be provided with an insulating coating, thus preparing an edgewise coil 43. This coil had an outer diameter of 11 mm, an inner diameter of 6 mm, and a height of 2 mm, and was a 5-turn coil. As a magnetic member B, a MnZn ferrite core 42 was prepared. The ferrite core 42 was provided with a ring-shaped space so that the coil can be fitted therein. The ferrite core 42 had an outer shape of 12×12×3 mm, a central column had a diameter of 5 mm, and the thickness of the bottom was 0.7 mm. After the coil 43 was inserted into the core 42, the residual gap was filled with the same paste containing magnetic powder as in the first example. In this case, the upper face of the coil was buried in the paste completely to be hidden, and legs of the coil were lead to the outside from a cutout portion 44 on the right side of the core shown in FIG. 12.

The core containing the coil and the magnetic paste was heated at 160° C. to cure the paste, thus forming a magnetic member A. Thus, an inductor with a size of 12×12×3 mm having the same configuration as in FIG. 2 was obtained. In order to make a comparison, the same inductor was prepared using a paste containing no magnetic powder. The values L of the inductors thus obtained were measured at 100 kHz and under superimposed DCs of 0A and 14A. In the inductor of the present invention, the values L at 0A and 14A were 1.5 μH and 1.2 μH, respectively. On the other hand, in the inductor of the comparative example, the values L at 0A and 14A were 0.5 μH and 0.4 μH, which were small.

Fifth Example

In the same method as in the first example, an atomized powder (with the mean particle diameter of 10 μm) of a sendust composition was prepared. To this powder, bisphenol A epoxy resin and a small amount of methyl ethyl ketone as a solvent were added and mixed in a mixing machine for five minutes, thus preparing a paste containing magnetic powder.

A planar one-turn coil was prepared, which was formed of a copper foil with a thickness of 50 μm and had an outer diameter of 8 mm and an inner diameter of 6 mm. As magnetic members B, two plate NiZn ferrite cores, each of which had a thickness of 0.8 mm and a square shape whose one side was 10 mm, were prepared. On one surface of one of the ferrite plates, the paste containing magnetic powder was applied as a thin layer, the planar coil was placed thereon, and the other ferrite plate was placed on the planar coil. Thus, the planar coil and the paste were sandwiched between the two ferrite plates. In this state, while compressed at a pressure of 50 kg/cm$^2$, they were heated at 160° C. to cure the paste, thus forming a magnetic member A. Thus, an inductor with the same configuration as in FIG. 4 was formed. In order to make a comparison, the same inductor was produced using a paste containing no magnetic powder. The values L of the inductors thus obtained were measured at 100 kHz and under superimposed DCs of 0A and 4A. In the inductor of the present invention, the values L at 0A and 4A were 1.2 $\mu$H and 1.0 $\mu$H, respectively. On the other hand, in the inductor of the comparative example, the values L at 0A and 4A were 0.4 $\mu$H and 0.4 $\mu$H, which were small.

Sixth Example

By the same method as in the first example, an uncured composite sheet was prepared, which contained an atomized powder of a sendust composition and had a thickness of about 0.3 mm. The uncured composite sheet was cut to have a size of 7×7 mm.

As a magnetic member B, a dust core of a permalloy (Fe—Ni) composition was prepared and was cut to have a size of 5×7×1.5 mm. A copper wire with a diameter of 0.5 mm whose surface had been coated with an insulating film was wound around the core in a rectangular solenoidal form to obtain a ten-turn winding. In addition, a plate NiZn ferrite sintered body with a size of 7×7×0.7 mm was prepared as a second magnetic member.

As a next step, inside a mold having a rectangular opening whose one side was 7 mm and two openings for leading the winding to the outside, the ferrite sintered body was placed and one uncured composite sheet was laid thereon. The magnetic member provided with the winding was placed on the uncured composite sheet, and three uncured sheets were laid thereon. In this state, they were heated and compressed for 15 minutes at a temperature of 150° C. under a pressure of 200 kg/cm$^2$. In this case, with the increase in temperature, the viscosity of the epoxy resin was decreased temporarily. Therefore, by applying heat and pressure at the same time, the pores in the uncured sheets were eliminated and therefore the filling density of the magnetic powder increased. At the same time, the mixture of the magnetic powder and the epoxy resin was fluidized and thus the gaps in the coil were filled with the mixture. In the later half of this step, the epoxy resin was cured with heat to obtain a composite magnetic body. Thus, the two kinds of magnetic members, the coil, and the composite magnetic body (the magnetic member A) were formed integrally. It was taken out from the mold and then was treated with heat at 150° C. for one hour to allow the curing of the epoxy resin with the heat to progress sufficiently, thus obtaining an inductor having a size of 7×7×3.5 mm.

In order to make a comparison, the same inductor was produced using a paste containing no magnetic powder. The values L of the inductors thus obtained were measured at 100 kHz and under superimposed DCs of 0A and 4A. In the inductor of the present invention, the values L at 0A and 4A were 4.3 $\mu$H and 3.5 $\mu$H, respectively. On the other hand, in the inductor of the comparative example, the values L at 0A and 4A were 1.7 $\mu$H and 1.7 $\mu$H, which were small.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A magnetic element, comprising:

a composite A containing a metallic magnetic powder in the amount of 50–70 vol. % with the remainder being a thermosetting resin;

a magnetic member B that is at least one selected from a ferrite sintered body and a pressed-powder magnetic body of a metallic magnetic powder; and a coil embedded in the composite A;

wherein a magnetic path is defined by a closed loop formed by a magnetic flux, the magnetic path being generated by an electric current that flows through the coil, and being determined by an arrangement of the coil, the composite A and the magnetic member B, the closed loop being formed by the magnetic member B and the composite A, and said magnetic path passes through the closed loop of magnetic member B and composite A.

2. The magnetic element according to claim 1, wherein the coil comprises turns that are spaced to define gaps and the gaps in the coil are filled with the composite A.

3. The magnetic element according to claim 1, wherein the coil is wound around the magnetic member B.

4. The magnetic element according to claim 1, wherein the magnetic member B is positioned outside the composite A in which the coil is embedded.

5. The magnetic element according to claim 4, wherein a plurality of plate-like magnetic members Bare included and are spaced 500 $\mu$m or less from one another, the composite A in which the coil is embedded is arranged in the space, and the coil is formed of a conductor wound in a planar shape.

6. The magnetic element according to claim 1, wherein the metallic magnetic powder comprises a surface oxide insulating layer.

7. The magnetic element according to claim 6, wherein the metallic magnetic powder contained in the composite A contains Fe as a main component and Al, and the oxide insulating layer on the surface of the metallic magnetic powder is an insulating layer that contains aluminum oxide as a main component and is formed by a heat treatment in the presence of oxygen.

* * * * *